US005711990A

United States Patent [19]

Guesdon et al.

[11] Patent Number: 5,711,990

[45] Date of Patent: Jan. 27, 1998

[54] METHOD OF COATING SHEET METAL

[75] Inventors: Philippe Guesdon, Paris; Jacques Houziel, Montataire, both of France

[73] Assignee: Sollac, Puteaux, France

[21] Appl. No.: 733,071

[22] Filed: Oct. 16, 1996

[30] Foreign Application Priority Data

Oct. 19, 1995 [FR] France ..... 95 12273

[51] Int. Cl.[6] ..... B05D 1/36; C23C 2/26

[52] U.S. Cl. ..... 427/201; 427/202; 427/205; 427/433

[58] Field of Search ..... 427/190, 191, 427/192, 201, 202, 205, 431, 433, 436

[56] References Cited

U.S. PATENT DOCUMENTS

| | | | |
|---|---|---|---|
| 3,017,689 | 1/1962 | Link et al. | 428/639 |
| 3,708,322 | 1/1973 | Jackson et al. | 427/196 |
| 3,712,826 | 1/1973 | Kimuro et al. | 427/191 |
| 4,111,154 | 9/1978 | Kissel et al. | 118/712 |
| 4,568,569 | 2/1986 | Wang | 427/205 |
| 4,873,153 | 10/1989 | Miller | 428/659 |

FOREIGN PATENT DOCUMENTS

| | | |
|---|---|---|
| 2236013 | 1/1975 | France . |
| 62-224699 | 2/1989 | Japan . |
| 2093053 | 3/1990 | Japan . |

*Primary Examiner*—Kathryn L. Gorgos
*Assistant Examiner*—William T. Leader
*Attorney, Agent, or Firm*—Sixbey Friedman Leedom & Ferguson; Thomas W. Cole

[57] ABSTRACT

A method of treating a metal layer present as a coating on a sheet metal substrate, wherein a powder is applied to said metal coating by propulsive means (e.g., spraying or the like) when said coating is at least partially in the liquid state. The powder is prepared by atomization in a manner adapted such that the powder is in the form of agglomerates having a mean diameter which is greater than the thickness of said liquid-state metal coating. With this use of this powder, it is easier to treat metal coatings in the liquid state, and the resulting treated coating is highly homogeneous, even if the atomized powder has a plurality of types of components.

7 Claims, No Drawings

METHOD OF COATING SHEET METAL

The invention relates to a method of treating sheet metal in which a metallic coating is applied to the sheet wherein a powder is applied by spray means or the like to a metal sheet when the coating is at least partly in a liquid state.

Methods for the galvanization of sheet steel are known in the prior art. In one such method, the sheet is immersed in a bath of liquid metal, and is withdrawn bearing a coating of the liquid metal. A powder is applied to the liquid coating, and the coating is then solidified. The thickness of the metal coating retained on the sheet steel can be regulated during removal of the sheet from the bath prior to application of the powder. Coating thicknesses obtained by this galvanization method range from 10 to 50 microns. In a variant of this galvanization method, the powder is applied well after the dipping. The sheet (bearing the coating) is heated to cause the coating to fuse at least partially, then the powder is applied to the fused coating, followed by solidification. At the time of application the powder enters the metal layer, being generally dispersed or dissolved therein.

Sheet metal coated by these methods has certain advantages such as improved surface appearance (no "zinc flowers") and improved formability (e.g. by press-forming). The methods also enable the range of compositions of the coating to be broadened. They also enable production of "composite" coatings, such as those having granular inclusions in a metallic matrix. Among the powders which may be used are oxide powders, or mixtures of metal powders and oxide powders.

The quality of the coating depends on, inter alia, the morphology of the powder applied to the sheet and the conditions under which it is applied. These parameters essentially determine the homogeneity of distribution of the applied material both over the surface of the fused metal coating and in the interior of said coating.

To maximize the dispersion and/or dissolution of the powder in the metal coating, generally one uses very fine powders. However, the use of very fine powders, particularly with elementary particle sizes less than 10 microns, has major drawbacks. Handling of very fine powders requires expensive sealing of systems, and the provision of very costly means of fire control and explosion prevention. Jap. Pat. 02-093053 proposes use of "atomized" powders (particulate materials formed by spray-drying or spray-casting a combination of a solid powder and a liquid adjuvant) to eliminate the risk of explosion when handling powders, particularly when such powders are comprised of, e.g., a vigorously oxidizable component such as magnesium.

When the metal coating on the sheet metal substrate is relatively thick, it may be difficult to apply the powder in a manner such that it will penetrate into the interior of the coating to a depth close to the sheet metal substrate. Thus, a fine powder, even an "atomized" powder, cannot be used to treat the coating through the entire thickness of the coating so as to obtain a coating of homogeneous composition throughout its thickness dimension.

If the applied powder material is comprised of a plurality of components, it is advantageous to modify and control the process by which the powder is applied so as to obtain homogeneous distribution of all the elementary components of the powder in the metal coating being treated. It often proves useful to prepare a homogeneous mixture of the components of the powder. This poses its own set of difficulties, particularly when the physical characteristics (such as density and particle size) of the different said components are very different.

The object of the present invention is to devise a method of treating a metal coating by applying a powder by spray means or the like whereby said powder is distributed homogeneously in the interior of said coating, even if said powder is comprised of a plurality of elementary powder components.

The principal claimed matter of the invention comprises a method of treating a metal layer present as a coating on a sheet metal substrate, particularly in a steel galvanizing line, wherein a powder is applied to said metal coating by spray means or the like when said coating is at least partially in the liquid state; characterized in that the powder is prepared by "atomization" by means adapted such that the powder is in the form of agglomerates (agglomerate particles) comprised of a plurality of elementary powder particles which agglomerates can be dispersed and/or dissolved in the said metal coating when said coating is in the liquid state, wherewith the mean "diameter" of said agglomerates is greater than the thickness of said liquid-state coating.

The invention may also have the following characteristic: The powder is prepared by means such that the mean "diameter" (particle size) of the powder particles is less than one half of the thickness of the said coating.

It is another object of the invention to devise powders prepared by the inventive method and having certain characteristics.

In particular, the claimed matter of the invention further comprises an "atomized" powder produced according to the inventive method, which powder has one or more of the following characteristics:

- the "apparent porosity" of said powder, corresponding to pores of pore size greater than 0.01 micrometer, is greater than 30%;
- the ratio of the mean "diameter" of the agglomerates to the mean "diameter" of the elementary powder particles is greater than 4;
- the powder contains a plurality of components of different natures and/or morphologies.

The invention will be better understood from the following description, offered by way of example:

Facilities for coating of sheet metal by dip-coating are per se known, and will not be described in detail here. The apparatus comprises, e.g., a metal dip-coating bath, means of removing excess coating so as to regulate the thickness of the metal coating on the sheet metal exiting the bath, and a device for applying the powder by spray means or the like onto the metal coating which coating is in the fused state, after excess coating has been removed.

To prepare the powder which is applied to the sheet, an "atomizing" apparatus of per se known type is employed, and a procedure which is per se known, starting with the component(s) of the material which is to be applied. E.g., one may start with one or more basic powders. The nature and proportions of these powders are adapted in a manner which is per se known, to the treatment of the metal coating which is to be employed.

A composition comprising said powders is fed to the "atomizing" apparatus. This composition may comprise, e.g., suspensions or solutions of said powders.

According to a variant of the invention, one may begin directly with suspensions (e.g. colloidal suspensions) and/or solutions containing the basic components of the material to be applied.

The composition fed is "atomized" so as to form an "atomized" powder, comprised of agglomerates of elementary particles of the basic component powders; these elementary particles may be of different natures and morphologies.

If the material to be applied contains a plurality of components in predetermined proportions, the "atomizing" may serve to pre-formulate a mixture, wherewith the conditions of "atomizing" are adapted in a manner which is per se known, so as to provide, in each agglomerate particle of the powder to be applied, a mixture of particles of the different components in said proportions.

In a manner which is per se known, one determines the "atomizing" conditions which will provide, according to the invention, agglomerates having mean "diameter" greater than the thickness of the fused metal coating after excess such coating has been removed.

Because the agglomerate particles in the "atomized" powder have a relatively large "diameter", the said agglomerate powder can be handled with relatively low risk of explosion or toxicity.

The basic powders which are chosen have particle sizes sufficiently small that homogeneous dispersion of the material to be applied is assured, in the metal coating. Preferably, the mean elementary particle size is less than one half the thickness of the fused metal coating.

Preferably, the conditions of "atomizing" are adapted, in a manner which is per se known, such that the ratio of the mean "diameter" of the agglomerates to the mean "diameter" of the powder particles is greater than 4.

To the extent needed, a binder material may be added to the composition fed to the "atomizing" apparatus, which binder has the function of increasing the cohesion of the agglomerate particles in said composition. A binder which might be used is polyvinyl alcohol. The conditions of "atomization", the nature of the binder, and the proportion of the binder in the feed composition are determined in a manner which is per se known, so as to obtain a cohesion which is low but sufficient.

By "sufficient" cohesion is meant a level such that the agglomerate particles generally withstand the handling of the agglomerate material subsequently to the "atomization" itself and up to the application to the sheet exiting the coating bath. The desired cohesion is nonetheless relatively weak, such that when the agglomerate particle strikes the sheet bearing the fused coating the cohesion will be ineffective and the elementary particles of which the agglomerate is comprised will be dispersed in said coating.

It is known to evaluate the cohesion of agglomerates by measuring the apparent porosity, defined as:

Total volume of pores÷Total volume of agglomerate.

Preferably, the proportion of binder and the conditions of "atomizing" are adjusted so as to obtain agglomerates having porosity greater than 30%, based on porosity measurements taking into account only pores of pore size greater than 0.01 micron.

There follows a description of the method of treating a metallic coating according to the invention, for a particular case of galvanizing of sheet metal.

Hot-dip galvanized sheet metal is produced with application of a powder to the metal coating by spray means or the like, in a manner which is per se known, except that the apparatus which applies the powder is fed by "atomized" powder as described above.

The sheet metal being coated is sheet steel, and the metal coating bath is a zinc bath.

According to variants of the invention, other dip-coating baths may be used, e.g. zinc alloy baths, or aluminum (or aluminum alloy) baths.

After the sheet steel is dipped in the bath, known methods are used to control the thickness of the metal coating to a predetermined value. Then, while the metal coating is still in the fused state, the "atomized" powder is applied to said coating by spray means or the like.

Preferably, the temperature of the metal coating is at least 10° C. above its melting temperature.

The conditions under which the "atomized" powder is propelled against the surface of the coating are adjusted such that the agglomerates comprising said powder are broken apart under the impact, thereby liberating the elementary particles and dispersing them into the fused metal coating.

This provides uniform distribution of the material applied, in the metal coating, in particular distribution which is uniform with respect to depth in the coating layer. The result is improved quality of the coated sheet steel.

Because the mean "diameter" of the agglomerates in the "atomized" powder is greater than the thickness of the metal coating itself, it is easier than according to the prior art to propel the powder with sufficient energy for the elementary particles to be dispersed into the deeper region of the coating near the sheet steel substrate. This represents a substantial advantage of the invention.

Because there is no direct handling of fine powders, difficult problems of environmental contamination, health, and safety (e.g. fire) are avoided.

It also turns out that the apparatus for applying the powder is much easier to operate with the use of powder comprised of "atomized" agglomerate, and energy savings are achieved in said apparatus because of a lower gas pressure drop. In general, it is much easier to apply by spray means or the like a powder of larger particle "diameter", such as an "atomized" powder comprised of agglomerates of large particle "diameter", than a powder of small particle "diameter".

When the material to be applied to the coating is comprised of a plurality of components, and an "atomizing" technique is used to pre-formulate a mixture of said components, the application apparatus is much easier and more flexible to operate. With a pre-formulated mixture, it is much easier to obtain uniform and homogeneous distribution of the elementary particles of the material to be applied, in the metal coating, than according to the prior art.

One material which is easy to use is an "atomized" multicomponent powder where the agglomerates are each comprised of a core consisting of one or more elementary particles, surrounded by another material. For example, the elementary particle(s) in the core may be silica particles and the surrounding material may be particles of metal of the same nature as that of the bath in which the sheet metal is dipped—zinc particles, in the example supposed.

When the "atomized" powder is applied to the coated surface, the periphery of each agglomerate is melted, liberating the oxide particles inside, whereby said particles are dispersed in the fused metal coating.

Thus the fused metal coating can be easily treated to produce a homogeneous product, as a result of the fact that the powder which is applied has been prepared by a particularly apt method (namely "atomization"), and the fact that the powder is comprised of agglomerates of apt size.

EXAMPLE

The purpose of this Example is to illustrate the invention for the case of treatment of a metal coating by means of a zinc metal powder.

The treatment was carried out as part of a galvanization process where, after dipping, the metal coating to be treated has a thickness of c. 10 micron.

As the elementary powder a zinc powder was used with mean particle "diameter" c. 4.5 micron. A suspension of this powder was prepared, and polyvinyl alcohol was added in the amount of 3 wt. % based on the initial weight of the powder. This suspension (feed composition) was "atomized", to obtain batches of agglomerated powder to be applied, wherein the agglomerates had mean particle "diameters" in the range 24–56 micron. The porosity of the powders obtained was c. 33.8%, and the internal porosity had mean "diameter" 0.06 micron.

The metal coating leaving the galvanizing bath was treated while still liquid, by applying a batch of the agglomerated powder, followed by solidification.

For all batches of the agglomerated powder (with mean agglomerate "diameters" ranging from 24 to 56 micron), the treated coating obtained was perfectly homogeneous over its entire depth.

We claim:

1. A method of treating a metal layer present as a coating on a sheet metal substrate comprising:

applying a metal coating as a layer on a sheet metal substrate;

while the metal coating is at least partially in a liquid state, atomizing a powder and applying the atomized powder to said metal coating by propulsive means;

wherein said atomized powder is in the form of agglomerates which are comprised of a plurality of elementary powder particles, said agglomerates being propelled against the surface of the metal coating while the metal coating is in the liquid state, the agglomerates being broken apart upon impact with the surface into the elementary powder particles which are dispersed and/or dissolved in the metal coating, and wherein the mean diameter of said agglomerates is greater than the thickness of the metal coating in the liquid state.

2. A method according to claim 1, wherein the mean diameter of said elementary powder particles is less than approximately one-half the thickness of said metal coating in the liquid state.

3. A method according to claim 1, wherein the apparent porosity of said agglomerates corresponding to pores of diameter greater than 0.01 micrometer is greater than 30%, where apparent porosity is defined as the total volume of pores divided by the total volume of agglomerates.

4. A method according to claim 1, wherein the ratio of the mean diameter of the agglomerates to the mean diameter of the elementary powder particles is greater than about 4.

5. A method according to claim 1, wherein the powder is comprised of components of different compositions and/or morphologies.

6. A method according to claim 1, wherein the step of applying a metal coating is performed in a sheet metal galvanizing line.

7. A method according to claim 1, wherein the atomized powder is applied by spraying.

* * * * *